US008428764B2

(12) United States Patent
Nagai et al.

(10) Patent No.: US 8,428,764 B2
(45) Date of Patent: Apr. 23, 2013

(54) MULTI-NEEDLE SEWING MACHINE

(75) Inventors: Masahiko Nagai, Nagoya (JP); Atsuya Hayakawa, Chita (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 179 days.

(21) Appl. No.: 13/023,968

(22) Filed: Feb. 9, 2011

(65) Prior Publication Data

US 2011/0203504 A1 Aug. 25, 2011

(30) Foreign Application Priority Data

Feb. 22, 2010 (JP) ..... 2010-035956

(51) Int. Cl.
*D05C 5/02* (2006.01)

(52) U.S. Cl.
USPC ..... 700/138

(58) Field of Classification Search ..... 700/138, 700/136, 137; 112/285, 445, 300, 453, 470.01, 112/470.06, 475.19
See application file for complete search history.

(56) References Cited

U.S. PATENT DOCUMENTS 5,947,043 A * 9/1999 Morita et al. ..... 112/102.5
5,974,992 A 11/1999 Asano
6,012,402 A 1/2000 Sekine
6,123,037 A 9/2000 Shimizu
6,311,097 B2 * 10/2001 Kwak ..... 700/138
6,352,043 B1 * 3/2002 Tajima et al. ..... 112/102.5
7,308,333 B2 * 12/2007 Kern et al. ..... 700/138
2002/0040258 A1 4/2002 Asano
2009/0020054 A1 1/2009 Taguchi et al.

FOREIGN PATENT DOCUMENTS

JP A 11-253676 9/1999
JP A 2009-022400 2/2009

OTHER PUBLICATIONS

Extended European Search Report issued in European Patent Application No. 11154861.6 dated Jun. 21, 2011.

* cited by examiner

*Primary Examiner* — Danny Worrell
(74) *Attorney, Agent, or Firm* — Oliff & Berridge, PLC

(57) ABSTRACT

A multi-needle sewing machine includes a plurality of needle bars having lower ends to which needles are attached, respectively, a needle bar selecting unit selectively switching one of the needle bars to a needle location, a stitch number obtaining unit and an allotting unit. An embroidery pattern including a plurality of partial patterns is sewn by the use of needle threads of colors differing per partial pattern, while the needle bars are selectively switched. The stitch number obtaining unit obtains the number of stitches necessary for sewing the partial patterns for every partial pattern. The allotting unit allots the needle threads to the needle bars so that the needle bars are prevented from being one-sided in the number of stitches, based on the obtained number of stitches, in order that one of the needle bars to be used for the sewing of each partial pattern may be determined.

8 Claims, 8 Drawing Sheets

FIG.3A

| EMBROIDERY DATA | |
|---|---|
| FIRST PARTIAL PATTERN EMBROIDERY DATA | THREAD COLOR 1 |
| | FEED DATA (Fxa, Fya) • • • <START POSITION> |
| | (x1,y1) • • <FIRST STITCH NEEDLE LOCATION> |
| | (x2,y2) • • <SECOND STITCH NEEDLE LOCATION> |
| | (x3,y3) • • <THIRD STITCH NEEDLE LOCATION> |
| | • • |
| | • • |
| | • • |
| | (xn,yn) • • <n-th STITCH NEEDLE LOCATION> |
| | STOP CODE |
| SECOND PARTIAL PATTERN EMBROIDERY DATA | THREAD COLOR 2 |
| | FEED DATA (Fxb, Fyb) • • • <START POSITION> |
| | (x1,y1) • • <FIRST STITCH NEEDLE LOCATION> |
| | (x2,y2) • • <SECOND STITCH NEEDLE LOCATION> |
| | (x3,y3) • • <THIRD STITCH NEEDLE LOCATION> |
| | • • |
| | • • |
| | • • |
| | (xn,yn) • • <n-th STITCH NEEDLE LOCATION> |
| | STOP CODE |
| THIRD PARTIAL | THREAD COLOR 3 |
| | FEED DATA (Fxc, Fyc) • • • <START POSITION> |

FIG.3

| |
|---|
| FIG.3B |
| FIG.3A |

| NEEDLE BAR NUMBER | PER-NEEDLE-BAR CUMULATIVE STITCH NUMBER Na | PER-NEEDLE CUMULATIVE STITCH NUMBER Nb |
|---|---|---|
| 1 | Na1 | Nb1 |
| 2 | Na2 | Nb2 |
| 3 | Na3 | Nb3 |
| 4 | Na4 | Nb4 |
| 5 | Na5 | Nb5 |
| 6 | Na6 | Nb6 |

FIG. 4

| NEEDLE BAR NUMBER | THREAD COLOR NUMBER AT SEWING START |
|---|---|
| 1 | THREAD COLOR 1 |
| 2 | THREAD COLOR 2 |
| 3 | THREAD COLOR 3 |
| 4 | THREAD COLOR 4 |
| 5 | THREAD COLOR 5 |
| 6 | THREAD COLOR 6 |

FIG. 5A

| NEEDLE BAR NUMBER | THREAD COLOR NUMBER AFTER SPOOL REPLACEMENT |
|---|---|
| 1 | |
| 2 | |
| 3 | THREAD COLOR 10 |
| 4 | THREAD COLOR 9 |
| 5 | THREAD COLOR 8 |
| 6 | THREAD COLOR 7 |

FIG. 5B

MULTI-NEEDLE SEWING MACHINE

CROSS-REFERENCE TO RELATED APPLICATIONS

This application is based upon and claims the benefit of priority from the prior Japanese Patent Application No. 2010-35956 filed on Feb. 22, 2010, the entire contents of which are incorporated herein by reference.

BACKGROUND

1. Technical Field

The present disclosure relates to a multi-needle sewing machine provided with a plurality of needle bars having lower ends to which needles are attached respectively and a needle bar selecting unit which selects one of the needle bars to be switchable to a needle location.

2. Related Art

For example, a multi-needle sewing machine having six needle bars have conventionally been used to form an embroidery pattern comprised of a plurality of partial patterns on a workpiece cloth. In sewing an embroidery pattern by the aforementioned multi-needle sewing machine, thread spools with different colors are set so as to correspond to the needle bars respectively. An embroidery pattern is sewn using needle threads of different colors while the needle bars are selectively switched by the needle bar selecting unit.

In one conventional technique, a sewing system uses a plurality of needle sewing machines in order that a sewing time may be reduced or shortened. More specifically, in the sewing system, a plurality of partial patterns is allotted to the respective multi-needle sewing machines so that sewing times of the respective sewing machines are rendered equal to each other or the differences between the sewing times are reduced. Further more specifically, for example, when an embroidery pattern is to be sewn onto workpiece cloths such as T-shirts by the sewing system so that a plurality of the same T-shirts may be made, a plurality of embroidery frames holding respective workpiece cloths is firstly prepared. The multi-needle sewing machines of the sewing system are set so as to sew only allotted partial patterns respectively. In this case, sewing times of the respective multi-needle sewing machines are set so as to be equal to or have small differences therebetween. Accordingly, after the first multi-needle sewing machine has finished sewing the partial pattern on the workpiece cloth, the embroidery frame is immediately attached to the second multi-needle sewing machine so that the remaining partial pattern is sewn on the workpiece cloth, while the next embroidery frame holding the workpiece cloth is attached to the first multi-needle sewing machine so that the partial pattern is sewn on the workpiece cloth. The above-described operations are repeated thereby to reduce a non-operating time as much as possible. Thus, the aforementioned sewing system can reduce an entire sewing time.

However, repeated sewing of the same partial pattern by the multi-needle sewing machines results in variations in the number of stitches between the needle bars in the above-described sewing system. More specifically, the difference in the cumulative stitch number is rendered larger between the needle bar corresponding to a needle thread of a color occupying a relatively larger area of the embroidery pattern and the needle bar corresponding to another needle thread of a color which is less used. This results in differences in a degree of wear between distal ends of the sewing needles of the respective needle bars. Accordingly, the needle of the former needle bar needs to be replaced by a new one earlier than the needle of the latter needle bar.

The above-described problem also occurs in the case where an embroidery pattern is sewn by a single multi-needle sewing machine. For example, needle bars are assigned with respective identification numbers 1 to 6 in a multi-needle sewing machine with six needle bars. One or more thread spools need to be changed when an embroidery pattern to be sewn by the multi-needle sewing machine comprises partial patterns of seven or more different colors. In this case, since the needle bar with a smaller identification number is given priority in selection, the cumulative number of stitches is increased regarding the needle bar with the smaller identification number out of the six needle bars. As a result, the distal ends of the needles attached to the needle bars are worn more severely than the needles of the other needle bars. Furthermore, each needle bar needs to be lubricated periodically. However, since the needle bars have different cumulative stitch numbers, the lubrication needs to be executed on the basis of the needle bar with the larger or largest cumulative number of stitches as described above. Thus, the conventional multi-needle sewing machines have problems to be overcome in conjunction with a maintenance efficiency, such as the differences in the replacement of the needles and the timing of lubrication.

SUMMARY

Therefore, an object of the disclosure is to provide a multi-needle sewing machine in which imbalance in the cumulative stitch number can be prevented between the needle bars, whereby the efficiency in the maintenance such as replacement of needles and lubrication can be improved.

The present disclosure provides a multi-needle sewing machine comprising a plurality of needle bars having lower ends to which needles are attached, respectively, a needle bar selecting unit which selectively switches one of the needle bars to a needle location, wherein an embroidery pattern composed of a plurality of partial patterns is sewn by the use of needle threads of colors differing per partial pattern, while the needle bars are selectively switched by the needle bar selecting unit, the machine further comprising a stitch number obtaining unit which obtains number of stitches necessary for sewing every partial pattern, and an allotting unit which allots the needle threads to the needle bars so that the needle bars are prevented from being one-sided in the number of stitches therebetween, based on the number of stitches obtained by the stitch number obtaining unit, in order that one of the needle bars to be used for the sewing of each partial pattern may be determined.

BRIEF DESCRIPTION OF THE DRAWINGS

In the accompanying drawings:

FIGS. 3A and 3B show an example of embroidery pattern data;

FIG. 4 shows correspondence relationship between per-needle-bar cumulative stitch numbers and per-needle cumulative stitch numbers, data of both being stored so as to correspond to the needle bar numbers respectively;

FIGS. 5A and 5B show examples of needle-bar thread color tables at start of sewing and after replacement of thread spools;

DETAILED DESCRIPTION

Figure 1:
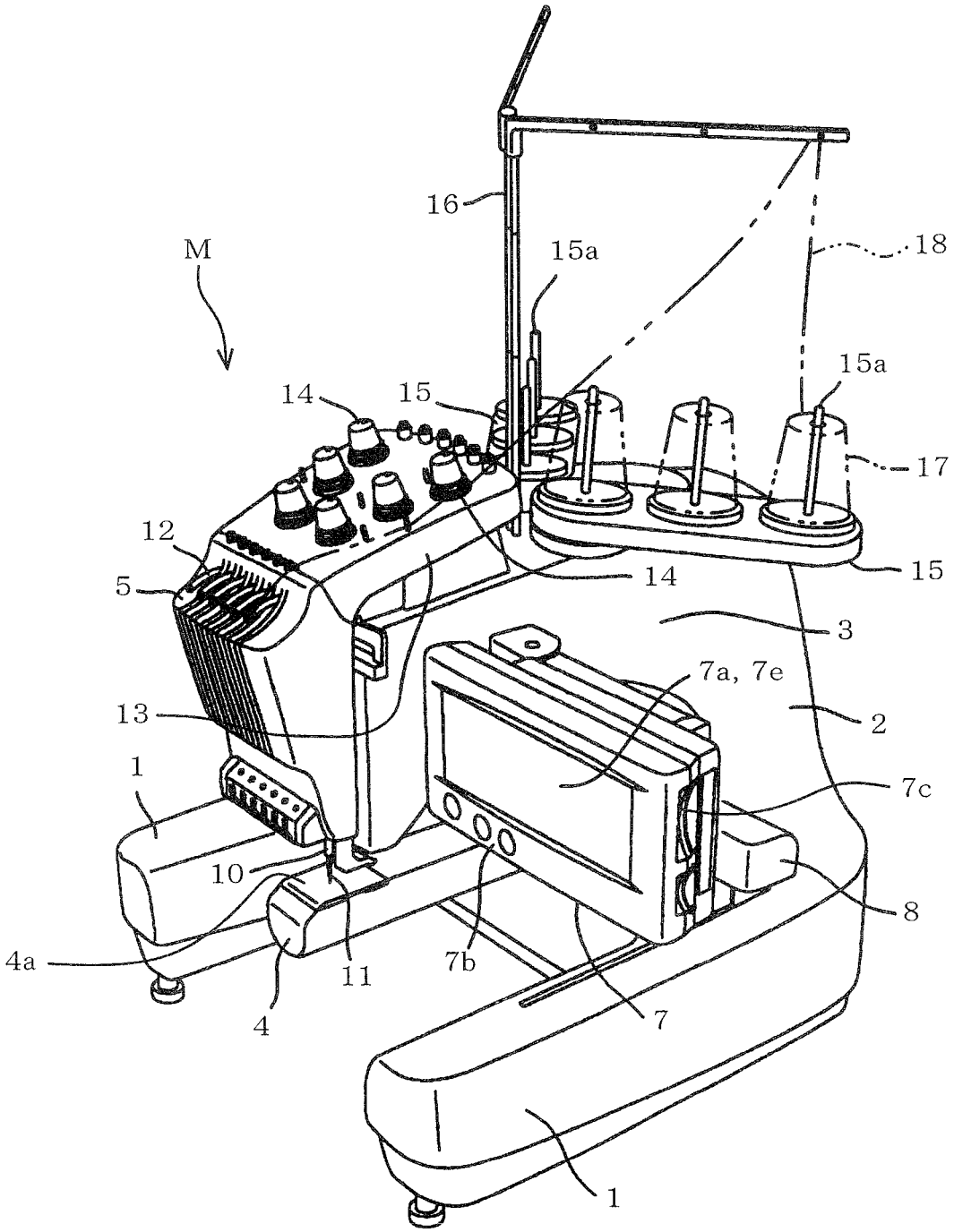
FIG. 1 is an overall perspective view of the multi-needle sewing machine in accordance with an example.

A first example of multi-needle sewing machine will be described with reference to FIGS. 1 to 8. Referring to FIG. 1, the side where the user is located relative to the multi-needle sewing machine M will be referred to as "front" and the side opposed to the front will be referred to as "rear."

The multi-needle sewing machine M includes a pair of legs 1 supporting the overall sewing machine, a pillar 2 standing from rear ends of the legs 1, an arm 3 extending frontward from an upper part of the pillar 2, a cylinder bed 4 extending frontward from a lower end of the pillar 2 and a needle-bar case 5 attached to a front end of the arm 3. The multi-needle sewing machine M further includes a control device 6 (see FIG. 2) and an operation panel 7.

A needle plate 4*a* is mounted on an upper surface of the cylinder bed 4. The needle plate 4*a* has a needle hole (not shown) which is formed therein to serve as a needle location of a needle 11 as will be described later. A carriage 8 is disposed on the upper sides of the legs 1 so as to extend in the right-left direction. The carriage 8 houses an X-direction drive mechanism 9*x* (see FIG. 2) which drives a frame mount (not shown) in the right-left or X direction. The legs 1 house a Y-direction drive mechanism 9*y* (see FIG. 2) which drives the carriage 8 in the front-rear or Y direction. An X-axis motor 30 and a Y-axis motor 31 serve as drive sources for the X-direction and Y-direction drive mechanisms 9*x* and 9*y* respectively. A workpiece cloth on which an embroidery pattern is to be sewn is held on a generally rectangular embroidery frame although neither shown. Thus, the embroidery frame is moved together with the carriage 8 in the X direction or together with the frame mount by the X-direction and Y-direction drive mechanisms 9*x* and 9*y*, whereby the workpiece cloth is fed for sewing purposes.

Six needle bars 10 are supported in the needle-bar case 5 so as to be movable upward and downward. One of the six needle bars 10 is shown in FIG. 1. The needle bars 10 are arranged right and left so as to vertically extend. The needle bars 10 have lower ends to which sewing needles 11 are attached respectively. The needle bars 10 are assigned with numbers 1 to 6 sequentially from the right one as viewed at the front of the sewing machine M. The needle-bar case 5 is further provided with six thread take-up levers 12 which correspond to the respective needle bars 10 and are vertically movable.

A slanted thread tension bracket 13 is fixed to an upper end of the needle-bar case 5. The thread tension bracket 13 is provided with six thread tension adjusters 14 for adjusting tensions of threads respectively. In the rear of the thread tension bracket 13 are provided a pair of right and left spool bases 15 and a thread guide mechanism 16 preventing threads from being entangled. The spool bases 15 and the thread guide mechanism 16 are located at the rear surface side of the arm 3 and are switchable between an accommodation position (not shown) where the spool bases 15 and the thread guide mechanism 16 are folded so as to extend in parallel with each other in the front-rear direction and a use position (see FIG. 1) where rears of the spool bases 15 and the thread guide mechanism 16 are spread open. Each spool base 15 has three spool pins 15*a* to which thread spools 17 are to be fitted respectively. Accordingly, six thread spools 17 whose number is equal to the number of the needles 11 can be held on the right and left spool bases 15. The needle threads 18 extending from the thread spools 17 are supplied to needle eyes (not shown) of the needles 11 through the aforesaid thread guide mechanism 16, the thread tension adjusters 14, the thread take-up levers 12 and the like, respectively.

A needle bar selecting mechanism 20 (see FIG. 2) is provided in the arm 3 for moving the needle-bar case 5 in the X direction. The needle bar selecting mechanism 20 is driven by a drive motor (not shown) as a drive source and serves as a needle bar selecting unit. More specifically, the needle bar selecting mechanism 20 is driven by the drive motor to selectively switch one of six groups of the needle bars 10 and the thread take-up levers 12 to the needle location. The switched needle bar 10 and thread take-up lever 12 are vertically moved at the needle location in a synchronous manner by a needle-bar drive mechanism 22 (see FIG. 2). The needle-bar drive mechanism 22 is driven by transmitting rotation of a sewing machine motor 21 (see FIG. 2) provided in the pillar 2 via a main shaft (not shown) thereto. Furthermore, on the front end of the cylinder bed 4 are mounted a rotary hook (not shown) accommodating a bobbin on which a bobbin thread (not shown) is wound and a cutting mechanism 19 (see FIG. 2) which cuts the needle thread 18 and the bobbin thread.

Stitches comprising the needle thread 18 and bobbin thread are formed on the workpiece cloth held by the embroidery frame by cooperation between the needle bar 10 and the thread take-up lever 12, and the rotary hook. In this case, the embroidery frame is transferred in the X and Y directions on the basis of embroidery pattern data which will be described later, whereby an embroidery pattern is sewn on the workpiece cloth.

The operation panel 7 serving as an informing unit is mounted on a right side of the arm 3 so as to be pivotable. The operation panel 7 includes an oblong liquid crystal display 7*a*. A plurality of switches including a start/stop switch 7*b* and a buzzer 7*d* (see FIG. 2) are provided on a lower front of the operation panel 7. The operation panel 7 includes a card connector 7*c* which is provided in one side thereof and has an insertion slot into which a memory card (not shown) is to be inserted. The memory card is a storage medium on which embroidery pattern data of various embroidery patterns is stored.

The liquid crystal display 7*a* displays various embroidery patterns, information about the needle thread 18 which is set so as to correspond to the needle bar 10 and cumulative stitch numbers of the respective needle bars 10 as will be described later. The liquid crystal display 7*a* further displays function names which cause the sewing machine to execute various functions necessary for the sewing operation, various pieces of sewing-related information, sewing conditions including thread tension, sewing speed and the like. A touch panel 7*e* constitutes a front of the liquid crystal display 7*a* and has a plurality of touch keys each comprising a transparent electrode. Various settings can be conducted by touching one or more touch keys. For example, various functions can be specified, numeric values of various sewing parameters can be set, and settings for replacement of the thread spools 17 can be carried out as will be described later.

Figure 2:
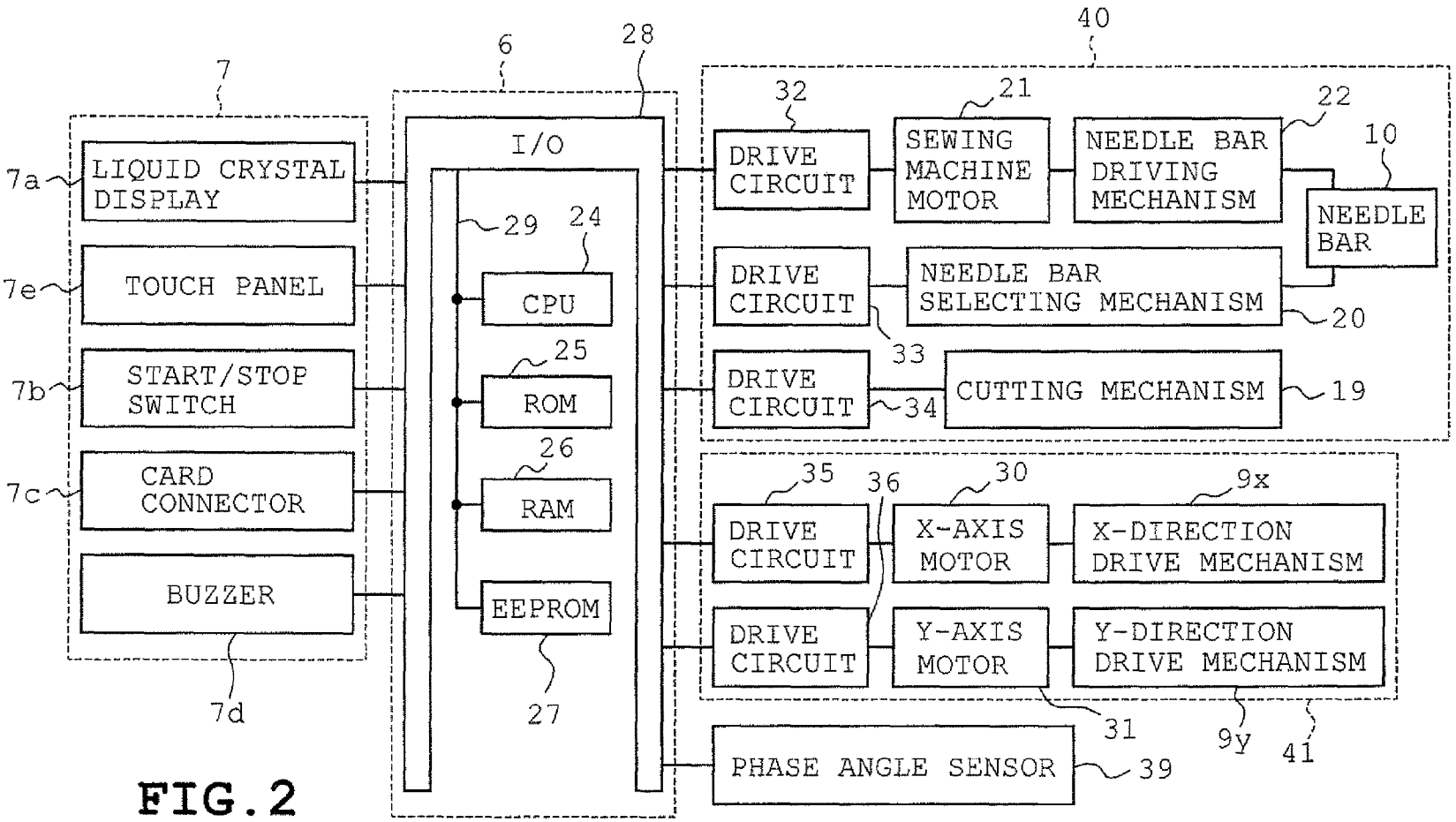
FIG. 2 is a block diagram showing an electrical arrangement of the machine.

An electrical arrangement of the control system of the multi-needle sewing machine M will now be described with reference to the block diagram of FIG. 2. The control device 6 is mainly configured by a microcomputer and includes a CPU 24, a ROM 25, a RAM 26, an EEPROM 27, an input/output (I/O) interface 28 and buses 29 connecting these devices 24-27 to the I/O interface 28. To the I/O interface 28 are connected the liquid crystal display 7*a*, the start/stop switch 7*b*, the card connector 7*c*, the buzzer 7*d* and the touch panel 7*e* of the operation panel 7. Drive circuits 32 to 36 are also connected to the I/O interface 28. The drive circuits 32 to 36 drive the sewing machine motor 21, the needle-bar selecting mechanism 20, the cutting mechanism 19, the X-axis motor 30 and the Y-axis motor 31 respectively. A phase angle sensor 39 is further connected to the I/O interface 28. The phase angle sensor 39 detects a rotation phase angle of the main shaft and includes a generally sectorial shutter fixed to the main shaft and an optical sensor comprising a photointerrupter fixed to the machine frame of the sewing machine M although the shutter and the optical sensor are not shown. The shutter of the phase angle sensor 39 is rotated together with the main shaft, and a rotation phase angle of the shutter is detected by the optical sensor. The phase angle sensor 39 is adapted to detect a phase angle of the main shaft when the needle 11 penetrates the workpiece cloth.

A sewing unit 40 is thus constituted by the needle bars 10, the needle 11, the rotary hook, the sewing machine motor 21, the needle-bar drive mechanism 22, the needle-bar selecting mechanism 20, the cutting mechanism 19, the drive circuits 32 to 34 and the like. A transfer unit 41 is constituted by the Y-direction drive mechanism 9*y* transferring the embroidery frame holding the workpiece cloth, the X-direction drive mechanism 9*x*, the X-axis motor 30, the Y-axis motor 31, the drive circuits 35 and 36 and the like. The control device 6 controls the above-described actuators in accordance with a sewing control program, embroidery pattern data and the like as will be described later. Thus, a sequence of sewing operation for the workpiece cloth is executed by cooperation between the sewing unit 40 and the transfer unit 41.

The ROM 25 stores embroidery pattern data, an all thread information table, a thread designation control program, a display control program and the like as well as the sewing control program. The all thread information table contains all the information about a plurality of types of threads used for the sewing inclusive of thread color data. The thread designation control program is provided for the user to make the connection between the thread color data of the needle thread 8 supplied from the thread spool 17 and the needle bar 10. The display control program is provided for control of the liquid crystal display 7*a* of the operation panel 7.

Figure 3B:
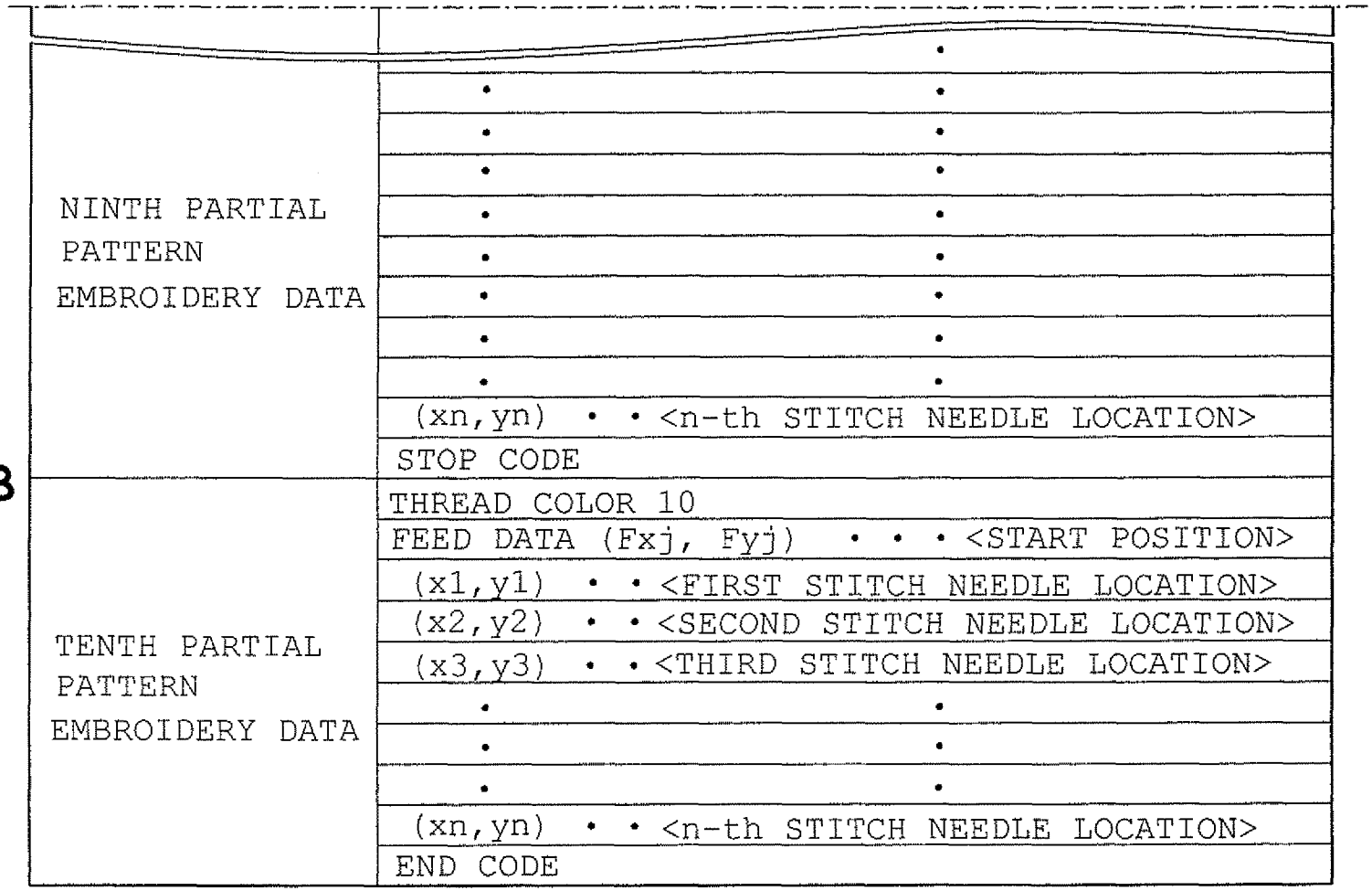

The embroidery pattern data is composed of data of a plurality of partial patterns of different colors. For example, the embroidery pattern data may comprise data of partial patterns of ten different colors as shown in FIGS. 3A and 3B. The data of ten partial patterns will be referred to as first to tenth partial pattern data. The embroidery pattern data includes data of ten thread colors (thread colors 1 to 10) for specifying a thread color, feed data for moving the embroidery frame to a sewing start position of each partial pattern, data of a plurality of needle locations, a stop code or an end code. More specifically, in FIG. 3A, the top first partial pattern data includes "thread color 1" which is data of pink that is actually designated by RGB values, for example. The feed data (Fxa, Fya) is provided for moving the embroidery frame to a sewing start position of each partial pattern in starting the sewing. The needle location data (x1, y1) to (xn, yn) designate coordinate positions of the needle 11 corresponding to the pink needle thread 18. Similarly, the second to tenth partial pattern data include thread color data "thread colors 2 to 10," feed data (Fxb, Fyb) to (Fxj, Fyj) and needle location data respectively. Furthermore, the stop code occupies each of ends of the first to ninth partial pattern data, and the end code occupies the end of the tenth partial pattern data.

The EEPROM 27 stores data of various cumulatives of stitch numbers per needle bar 10. The cumulative data will now be described with further reference to FIG. 4 as well as FIGS. 1 to 3B. Firstly, the total cumulative stitch number N is obtained by accumulating counts of stitch numbers since initial use of the sewing machine M by the user. In more detail, the control device 6 counts the number of stitches based on a phase angle signal supplied from the phase angle sensor 39 thereto. Suppose now that a phase angle of the main shaft is at 0° when the needle bar 10 occupies an uppermost position. In the case where the phase angle of the main shaft is at 115° when the needle 11 penetrates the workpiece cloth, for example, the total cumulative stitch number N is incremented one every time the phase angle is detected by the phase angle sensor 39. On the other hand, per-needle-bar cumulative stitch numbers Na1 to Na6 and per-needle cumulative stitch numbers Nb1 to Nb6 as shown in FIG. 4 correspond to the six needle bars 10 of the needle numbers 1 to 6 and the needles 11 respectively and are obtained on the basis of the total cumulative stitch number N by a calculating method as will be described later.

The per-needle-bar cumulative stitch numbers Na1 to Na6 are cumulatives of stitch numbers of the needle bars 10 corresponding to the needle bar Nos. 1 to 6. On the other hand, the per-needle cumulative stitch numbers Nb1 to Nb6 are cumulatives of stitch numbers of the needles 11 attached to the needle bars 10 respectively. Since these cumulative stitch numbers Na1 to Na6 and Nb1 to Nb6 are displayed on a screen of the liquid crystal display 7*a*, the cumulative stitch numbers Na1 to Na6 and Nb1 to Nb6 are indexes of maintenance of the sewing machine M. More specifically, the per-needle cumulatives Nb1 to Nb6 are indexes (5 million stitches, for example) of needle replacement in each needle bar 10 and initialized when the needle 11 is replaced by a new one. The display 7*a* displays a needle replacement history screen (not shown) carrying the message that "the needle is replaced." in the initialization of the cumulative stitch numbers Nb1 to Nb6. When the needle bar number corresponding to the needle 11 to be replaced is selected on the needle replacement history screen, the initial value of "0" is written onto the corresponding one of the per-needle cumulatives Nb1 to Nb6 as an initial value. Thus, the non-volatile EEPROM 27 storing the cumulative stitch numbers N and Na1 to Na6 and Nb1 to Nb6 as the aforesaid cumulative data serves as a storage unit. The operation panel 7 for input of the initial values and the control device 6 serve as an initial value input unit.

The EEPROM 27 further stores a needle bar thread color table which shows correspondence between color data of the thread spools 17 and the needle bars 10 respectively as shown in FIG. 5A. When the replacement of the thread spool 17 is necessary in the sewing, a thread spool setting screen (not sown) is displayed on the display 7*a*. A setting screen allotting thread colors per needle bar 10 is displayed on the basis of the embroidery pattern data, per-needle cumulative stitch numbers Nb1 to Nb6. For example, when the displayed thread colors are allotted in the sequence of the needle bar Nos. as shown in FIG. 5A, the user sets the thread spools 17 of thread colors 1 to 6 corresponding to the needle bars 10 of the needle Nos. 1 to 6 while referring to the displayed thread colors. Then, the sewing machine M is threaded with the needle threads 18. The colors of the needle threads 18, that is, data of thread colors of the thread spools 17 set on the multi-needle sewing machine M are stored on the EEPROM 27 so as to correspond to the needle bar Nos. serving as thread spool color data. Furthermore, for example, sensors may be provided on the spool pins 15*a* so as to detect thread spool color data respectively, so that the thread spool color data after replacement of thread spools 17 is detected by the sensors and stored on the EEPROM 27. Additionally, the thread spool color data may be stored on the EEPROM 27 by user's operating the touch panel 7*e*.

The RAM 26 is provided with a memory which stores the total cumulative stitch numbers N read from the EEPROM 27 stored while counting up (renewing) the numbers N. The RAM 26 is further provided with a memory which stores embroidery pattern data read from the ROM 25 or the memory card in the sewing and other memories such as various buffers, counters and the like as the need arises. The embroidery pattern data is to be stored on the RAM 26 in a sewing sequence (the sequence of thread colors 1 to 10, for example).

Figure 6:
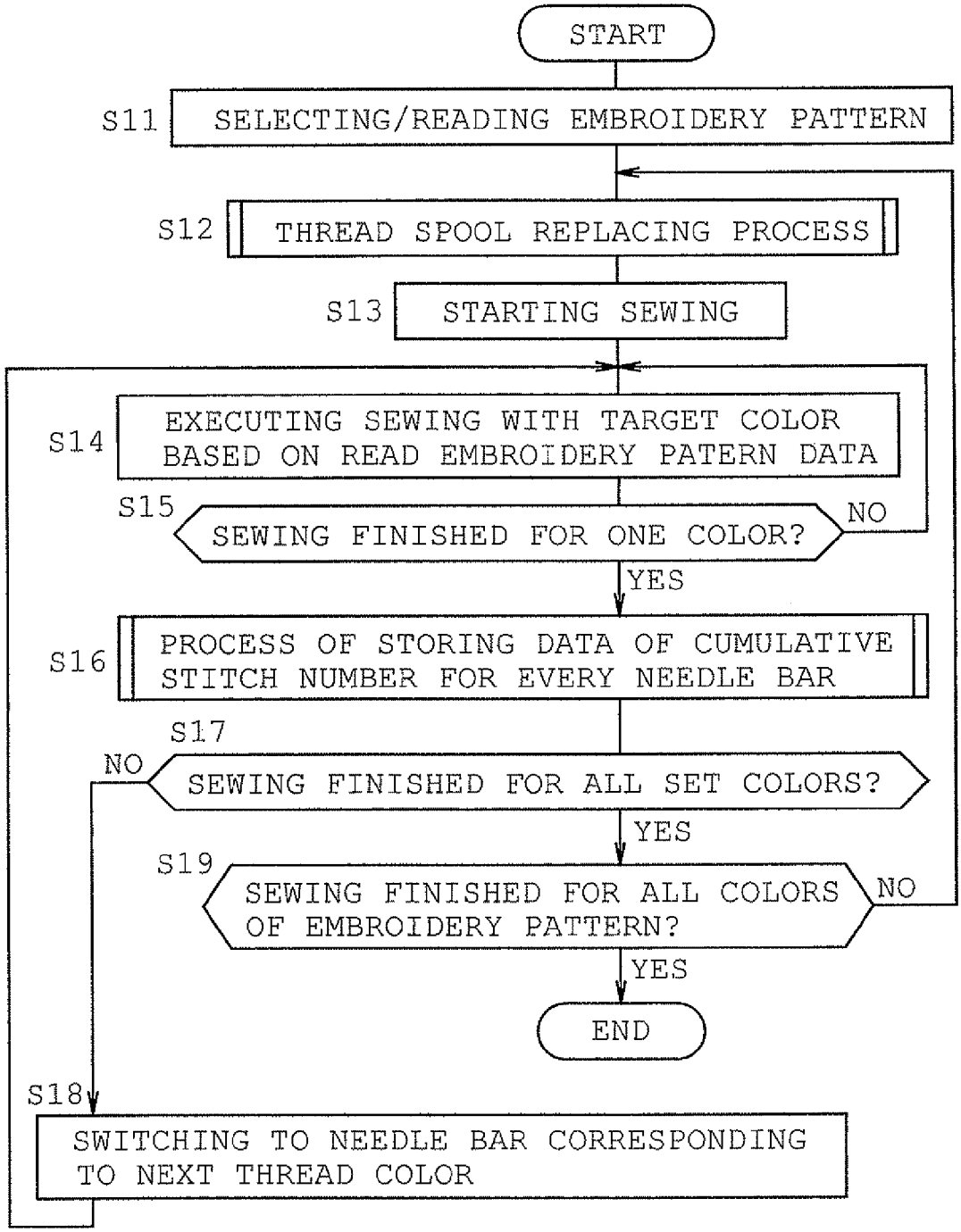
FIG. 6 is a flowchart showing a control manner of sewing an embroidery pattern.
Figure 7:
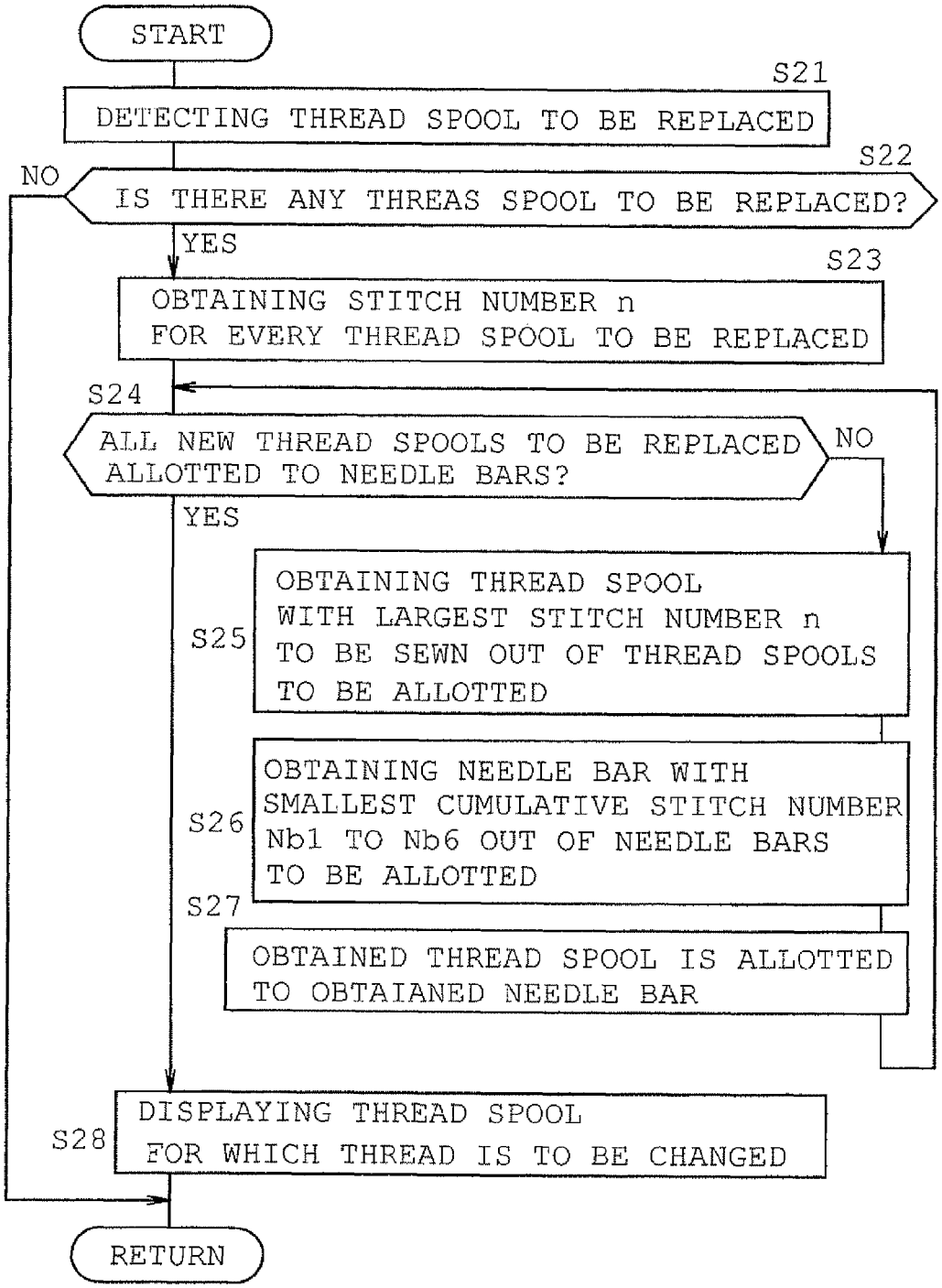
FIG. 7 is a flowchart showing a process of allotting needle threads.
Figure 8:
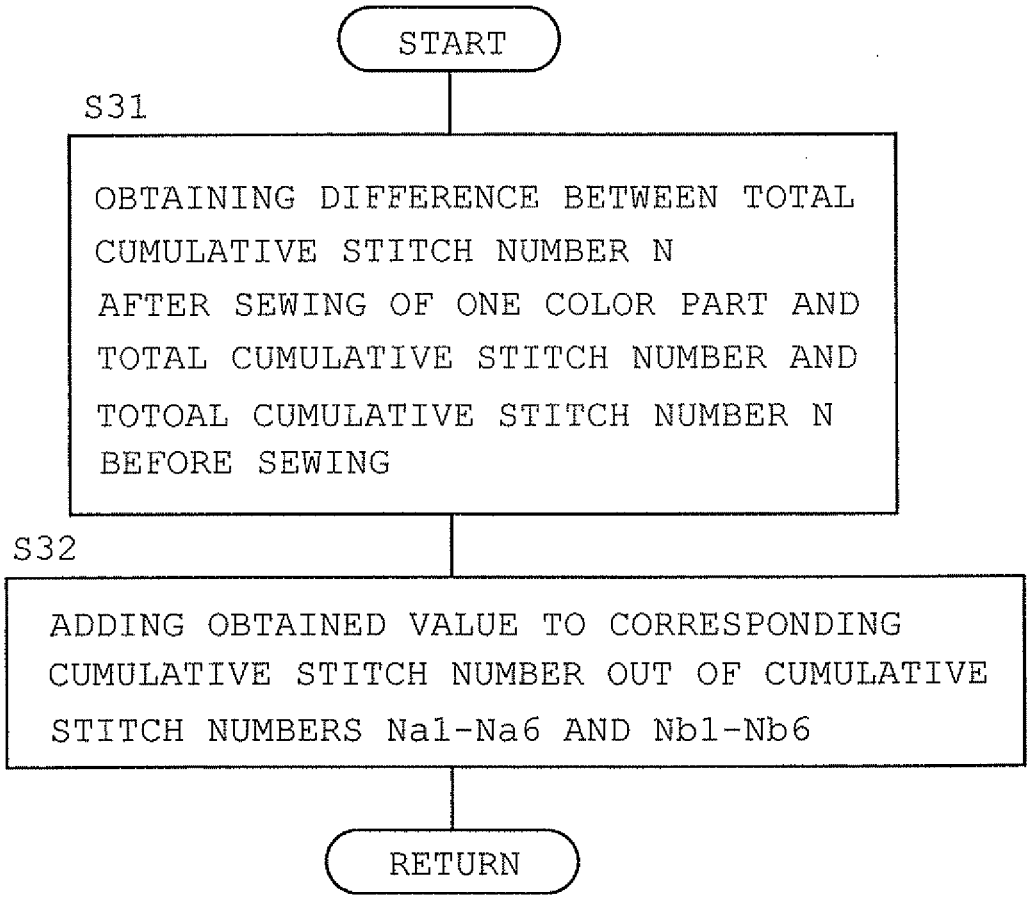
FIG. 8 is a flowchart showing a process of obtaining cumulative stitch number per needle bar.

A sewing control manner of the multi-needle sewing machine will be described with reference to FIGS. 6 to 8 as well as FIGS. 1 to 5B. In this case, an embroidery pattern comprising a plurality of partial patterns of different colors (the aforesaid ten colors, for example) is sewn on the workpiece cloth. FIGS. 6 to 8 show processing procedures of the control device 6. Symbol Si (where i=11, 12, 13 . . . ) designates steps in FIGS. 6 to 8. The thread spools 17 of ten different colors are necessary for the sewing of embroidery pattern in the example. It is supposed that six thread spools 17 of different colors are set on the spool bases 15 and also that an EEPROM 27 stores spool color data or spool color data of six colors as shown in FIG. 5A.

Firstly, at step S11, a pattern selecting screen (not shown) is displayed on the liquid crystal display 7*a*. The user then touches the touch key corresponding to a desired one of a plurality of embroidery patterns on the selecting screen. As a result, embroidery pattern data of a selected embroidery pattern is read from the ROM 25 to be developed onto a memory of the RAM 26. Subsequently, at step S12, a thread spool replacing process is executed on the basis of the read embroidery pattern data (allotting process as will be described later; and see FIG. 7). When a thread spool 17 to be replaced has been found in sewing the embroidery pattern (step S21 and YES at step S22) in the thread replacing process, the thread spool 17 is specified for every needle bar 10. Since six different colors of thread spools 17 are set in the described example (NO at step S22), a further control manner will be described later and the control device 6 returns to step S13 in FIG. 6.

When the user operates the start/stop switch 7*b* on the operation panel 7, the sewing machine motor 21 is driven so that a sewing operation is started on the basis of various pieces of information inclusive of the embroidery pattern data (step S13). For example, when the sewing operation is executed on the basis of embroidery pattern data as shown in FIG. 3, data of THREAD COLOR 1 is firstly read as thread color data of first partial pattern data. Furthermore, the control device 6 selects the needle bar 10 of needle bar No. 1 on which the thread spool data corresponding to THREAD COLOR 1, referring to thread spool color data as shown in FIG. 5A. The transfer unit 41 is controlled on the basis of feed data (Fxa, Fya) and needle location data (x1, y1) so that a sequence of sewing operation is executed on the workpiece cloth with the use of THREAD COLOR 1 by cooperation of the transfer unit 41 and the sewing unit 40 (step S14 and NO at step S15). Furthermore, the total cumulative needle number N is incremented on the basis of the detection signal generated by the phase angle sensor 39 during the sewing operation. Thus, the sewing process is executed until the last needle location data (xn, yn) of the first partial pattern is reached, whereupon the first partial pattern is sewn with a single color of thread.

The control device 6 subsequently advances to step S16 to execute a process of storing per-needle-bar cumulative stitch numbers Na1 to Na6 and per-needle cumulative stitch numbers Nb1 to Nb6 (see FIG. 8). More specifically, the difference is obtained between the total cumulative stitch number N at the finish time of the first partial pattern sewing and the total cumulative stitch number before the first partial pattern sewing (the total cumulative stitch number N stored on the EEPROM 27) (step S31). The obtained value is indicative of the actual number of stitches formed by the needle bar No. 1 used in the sewing of the first partial pattern and the needle 11 attached to the needle bar No. 1. Accordingly, the obtained value is added to both the per-needle-bar cumulative stitch number Na1 and the per-needle cumulative stitch number Nb1 in order that the actual stitch number may be reflected (step S32). The total cumulative stitch number N, the per-needle-bar cumulative stitch number Na1 and the per-needle cumulative stitch number Nb1 all of which are stored on the EEPROM 27 are rewritten into the respective latest cumulative stitch numbers N, Na1 and Nb1 obtained subsequent to the sewing of the first partial pattern, thereby being renewed. The control device 6 thereafter returns to step S17. The cumulative stitch numbers Na1 to Na6 and Nb1 to Nb6 displayed per needle bar 10 on the liquid crystal display 7*a* are renewed every after execution of addition at step S32.

The control device 6 subsequently determines whether or not the six colors of threads set on the multineedle sewing machine M have been sewn (step S17). In this case, no processing has been executed with respect to the remaining five thread colors starting with the thread color 2 (NO at step S17). As a result, the No. 2 needle bar 10 corresponding to THREAD COLOR 2 is selected (step S18). The same sewing process as for THREAD COLOR 1 is executed for the second partial pattern of THREAD COLOR 2 (step S14 and NO at step S15). Furthermore, when the sewing of the second partial pattern has been finished (YES at step S15), the total cumulative stitch number N, the per-needle-bar cumulative stitch number Na2 and the per-needle cumulative stitch number Nb2 all of which are stored on the EEPROM 27 are rewritten into the respective latest cumulative stitch numbers N, Na2 and Nb2 obtained subsequent to the sewing of the second partial pattern, thereby being renewed. Steps S14, S15, S16, S17 and S18 are sequentially executed so that the first to sixth partial patterns of the respective THREAD COLORS 1 to 6 are sewn.

Still furthermore, the control device 6 renews the cumulative stitch numbers Na1 to Na6 and Nb1 to Nb6 corresponding to the needle bars 10 used in the sewing of the respective partial patterns, based on the total cumulative stitch number N (step S16). When the sewing of the six partial patterns corresponding to the six thread colors set before start of the sewing has been finished (YES at step S17), the control device 6 determines whether or not the sewing of all the partial patterns of the embroidery pattern has been finished on the basis of the embroidery pattern data (step S19). In this case, since no processing has been executed with respect to the remaining four of ten thread colors starting with THREAD COLOR 7 (NO at step S19), the user needs to replace the thread spools 17 of the remaining four colors. For this purpose, an allotting process is executed prior to a thread replacement. For example, new thread spools 17 (needle threads 18) to be added are allotted so that the per-needle cumulative stitch numbers Nb1 to Nb6 are prevented from being one-sided among the needle bars 10 (see FIG. 7).

In the allotting process, the control device 6 advances to step S21 to execute a collating process to detect the thread spools 17 which need to be replaced with new ones. More specifically, the spool color data (THREAD COLORs 1 to 6 as shown in FIG. 5A) set on the EEPROM 27 is collated with data of four colors of unsewn partial patterns (thread colors 7 to 10). The control device 6 then advances to step S22 to determine whether or not the thread spools 17 need to be replaced, based on the results of collation.

When the data of four colors of unsewn partial patterns is not present in the spool color data and accordingly the control device 6 determines that the thread spools 17 need to be replaced (YES at step S22), the control device 6 obtains the numbers of stitches necessary for the sewing of the respective unsewn seventh to tenth partial patterns. These stitch numbers are obtained by reading the number n of stitches (see needle location of n-th stitch in FIG. 3) contained in respective needle location data in the seventh to tenth partial patterns, for example. Accordingly, the number of stitches is obtained as the stitch number n of each one of the new thread spools 17 to be replaced in order that each one of the seventh to tenth partial patterns may be sewn.

The needle bars 10 necessary for the sewing of the seventh to tenth partial patterns will be determined in the following manner. When the thread spools 17 of four new colors are allotted to the needle bars 10 (NO at step S24), the control device 6 obtains the thread color data of the needle bar 17 with the largest stitch number n (step S25). On the other hand, the control device 6 obtains the needle bar No. with the smallest out of per-needle-bar cumulative stitch numbers Nb1 to Nb6 (step S26), so that the thread color data obtained at step S25 is allotted to the obtained needle bar No. (step S27).

The processing at steps S25 to S27 will be described in more detail with a more specific example. For example, the seventh to tenth partial patterns have such a relationship that stitch number n7 is the smallest and stitch number n10 is the largest as shown by an inequation of n7>n8>n9>n10. On the other hand, the current per-needle cumulative stitch number has such a relationship that stitch number n1 is the largest and stitch number n6 is the smallest as shown by inequation of Nb6<Nb5<Nb4<Nb3<Nb2<Nb1. In this case, at steps S25 to S27, THREAD COLOR 7 with the largest stitch number n and needle No. 6 with the smallest stitch number n are obtained, and the thread spool 17 of thread color 7 is allotted to the needle bar 10 with needle bar No. 6. The control device 6 subsequently determines whether or not all the thread spools 17 of unsewn four colors have been allotted to the needle bars 10 (step S24). In this case, no processing has been executed with respect to data of thread colors 8 to 10 in data of the thread spools 17 with four thread colors (NO at step S24). As a result, the data of thread color 8 with the largest stitch number n of three thread colors 8 to 10 is obtained, and the needle bar number 5 with the smallest per-needle cumulative stitch number of five needle bar Nos. 1 to 5 is obtained. The thread spool 17 with THREAD COLOR 8 is allotted to the No. 5 needle bar 10. The processing at steps S24 to S27 is repeatedly executed with respect to the thread colors sequentially from THREAD COLOR 7 with the largest stitch number to THREAD COLOR 10. Accordingly, the thread spools 17 of THREAD COLORs 7 to 10 are allotted to the needle bars 10 sequentially from needle No. 6 with the smallest per-needle cumulative stitch number to needle No. 3 respectively (see FIG. 5B).

Thus, the control device 6 determines, at step S24, that all the four thread spools 17 of thread colors 7 to 10 have been allotted to the needle bars 10 respectively (YES). The liquid crystal display 7*a* displays a thread spool set screen (not shown) on which the needle bars 10 correspond to the thread colors of thread spools 17 respectively (step S28). The thread colors of the thread spools 17 are allotted to the respective needle bars 10 in a sequence as shown in FIG. 5B. In this case, the user arranges the thread spools 17 of thread colors 10 to 7 corresponding to the No. 3 to 6 needle bars 10, while referring to the thread colors on the screen, respectively. Furthermore, as the result of thread spool replacement, the control device 6 renews the needle bar thread color table on the EEPROM 27 by rewriting thread spool color data of the newly set four colors, thereafter finishing the allotting process and returning to step S13 in FIG. 6.

When the start/stop switch 7*b* on the operation panel 7 is operated after the thread spool replacement, the sewing machine motor 21 is re-driven so that sewing is started from the seventh partial pattern in the aforementioned sewing sequence. More specifically, the thread color 7 of the seventh partial pattern data is read and the thread spool color data as shown in FIG. 5B is referred to. As a result, the No. 6 needle bar 10 is selected on which the thread spool color data corresponding to the thread color 7 is set. Subsequently, the same sewing process as with respect to the thread colors 1 to 6 is executed with respect to the seventh partial pattern 7 of THREAD COLOR 7 (step S14 and NO at step S15). When the sewing of the seventh partial pattern has been finished (YES at step S15), the total cumulative stitch number N, per-needle-bar cumulative stitch number Na6 and per-needle cumulative stitch number Nb6 all stored on the EEPROM 27 are renewed into the respective latest values (step S16). Thus, the control device 6 repeatedly executes the processing at steps S14 to S18 from THREAD COLOR 7 to THREAD COLOR 10 thereby to execute the sewing of four colors of the seventh to tenth partial patterns per thread color. Furthermore, every time the sewing of each partial pattern has been finished, the cumulative stitch numbers Na3 to Na6 and Nb3 to Nb6 corresponding to the needle bar 10 used for each partial pattern are renewed on the basis of the total cumulative stitch number N (step S16). The differences among the renewed per-needle cumulative stitch numbers Nb1 to Nb6 of the needle bars 10 are rendered smaller as the result of execution of the sewing on the basis of the aforementioned allotting process. The sewing is finished with respect to the four colors set at the time of replacement of the thread spools 17 (YES at step S17), and all the partial patterns of the embroidery pattern are sewn (YES at step S19).

The allotting process in the sewing control renders the differences among the per-needle cumulative stitch numbers Nb1 to Nb6 smaller than before execution of the sewing, as described above. Accordingly, repeated execution of the sewing in the foregoing manner gradually uniforms the per-needle cumulative stitch numbers Nb1 to Nb6 approximately, so that the per-needle cumulative stitch numbers Nb1 to Nb6 substantially simultaneously reach, for example, the number of 5 millions that is a measure of needle replacement. In this case, the user can replace all the six needle bars 11 together after finish of the sewing or in the thread spool replacement. The per-needle cumulative stitch numbers Nb1 to Nb6 are reset to zero by the initial value input unit after replacement of the needle bars 11. The above-described sewing control may be provided with an additional step of determining whether or not the per-needle cumulative stitch numbers Nb1 to N6 have reached a predetermined number (5 or 1 million, or the like). This additional determining step may be provided immediately after step S32, for example. When the per-needle cumulative stitch numbers Nb1 to N6 have reached 5 million stitches, for example, a message, "Replace needle bars with new ones" can be displayed on the liquid crystal display 7*a* or an audio message can be given or the buzzer 7*d* can be activated.

Furthermore, per-needle-bar cumulative stitch numbers Na1 to Na6 of the needle bars 10 are also substantially uniformed. Accordingly, a message prompting the user to lubricate the needle bars 10 may be displayed on the liquid crystal display 7*a*.

The control device 6 and the operation panel 7 serve in combination as an informing unit that informs the user of information about the stitch numbers of the needle bars 10 by way of the liquid crystal display 7*a*, the buzzer 7*d* or the like. The control device 6 and the embroidery pattern data in relation to execution of step S12 serve in combination as a stitch number obtaining unit which obtains the number of stitches per partial pattern necessary for the sewing of a plurality of partial patterns. Furthermore, the control device 6 serves as an allotting unit which allots thread color data of the needle thread 18 to the needle bar 10 in relation to execution of steps S21 to S28. The control device 6 and the phase angle sensor 39 serve in combination as a counting unit which counts the number of stitches that are being sewn.

In the above-described multineedle sewing machine M, the control device 6 functions as an allotting unit or a stitch number obtaining unit which allots the needle thread 18 to the needle bar 10 based on the obtained stitch numbers n7 to n10 so that the numbers of stitches are prevented from differing from each other or one another. More specifically, the stitch numbers necessary for the sewing of the partial patterns of the embroidery pattern to be sewn can be obtained per partial pattern (per thread color) by the stitch number obtaining unit. The needle thread 18 of the color corresponding to each partial pattern is allotted by the allotting unit to the needle bar 10 on the basis of the obtained stitch numbers n7 to n10 so that the numbers of stitches are prevented from differing among the needle bars 10. Consequently, when each partial pattern is sewn by the use of the needle bar to which the needle thread 18 has been allotted, the number of stitches of each needle bar 10 can be prevented from varying among the needle bars 10. Furthermore, the degrees of wear in the distal ends of the needles attached to the respective needle bars 10 can be substantially uniformed, whereupon the needles 11 can be replaced with new ones collectively at a predetermined time. Additionally, the needle bars 10 can periodically be lubricated at a predetermined time without specifying the needle bar with a larger cumulative stitch number, whereby the maintenance can be rendered more efficient.

The control device 6 allots the needle thread 18 to the needle bar 10 based on the cumulative stitch numbers Nb1 to Nb6 so that the differences among the cumulative stitch numbers Nb1 to Nb6 are rendered smaller. Thus, the differences among the needle bars 10 can accurately be grasped as the differences among cumulative stitch numbers Nb1 to Nb6 in the needle bars 10 respectively. Consequently, the differences among the needle bars 10 can be reduced among the needle bars 10 as much as possible by allotting the needle thread 18 in consideration of the cumulative stitch numbers Nb1 to Nb6. Particularly in the foregoing example, data of per-needle cumulative stitch numbers Nb1 to Nb6 is stored on the EEPROM 27 serving as the nonvolatile storage unit and can be cleared at every needle replacement by the initial value input unit. Consequently, the time for replacement of each needle 11 can be accurately grasped.

The control device 6 is configured to execute the allotting of the needle thread 18 to the needle bar 10 every time of replacement of the thread spool 17 of the needle thread 18. As a result, the differences in the stitch numbers can be corrected every time the sewing is executed after the thread change. Furthermore, since the thread change is carried out before the sewing or with the sewing being interrupted, the thread change can be carried out efficiently by making use of the thread replacement time without missing the timing for allotting.

The multineedle sewing machine M is provided with an informing unit which informs the user of information about the stitch number of every needle bar 10. For example, the operation panel 7 can be used as the informing unit to inform the user of the information about every needle bar 10. Consequently, the user can carry out the maintenance including needle replacement and lubrication of the needles 11.

The foregoing example should not be restrictive but may be modified or expanded as follows. Both per-needle-bar cumulative stitch numbers Na1 to Na6 and per-needle cumulative stitch numbers Nb1 to Nb6 are obtained on the basis of the total stitch number N in the example. However, at least one of per-needle-bar cumulative stitch numbers Na1 to Na6 and per-needle cumulative stitch numbers Nb1 to Nb6 may be obtained on the basis of the total stitch number N, instead. For example, only per-needle-bar cumulative stitch numbers Na1 to Na6 may be obtained on the basis of the total cumulative stitch number M and may be stored on the EEPROM 27 or displayed on the liquid crystal display 7*a*, instead of steps S31 and S32 in FIG. 8. Steps S26 and S27 may be executed so that the needle bar number corresponding to the smallest one of the per-needle-bar cumulative stitch numbers Na1 to Na6 is obtained and so that the thread color data obtained at step S25 is allotted to the obtained needle bar number, instead of the per-needle cumulative stitch numbers Nb1 to Nb6. In this modified configuration, the differences in the stitch number can be corrected directly among the needle bars 10 although the differences in the stitch number have been corrected among the needles 11 of the respective needle bars 10 in the foregoing example. Consequently, the maintenance for the needle bars 10 including the replacement of needle 11 can be executed with reference to the per-needle-bar cumulative stitch numbers Na1 to Na6 at a predetermined time in bulk.

The counting unit may be arranged to directly count the stitch number of each needle bar 10 by the use of a plurality of sensors detecting the vertical position of each needle bar 11. The storage unit should not be limited to the foregoing EEPROM 27 but may be one of various storage media such as flash memory.

Although the needle thread 18 is allotted every time of thread replacement in the foregoing example, an allotting process in which even the thread spool 17 set is allotted to the needle bar 10. More specifically, the steps S21 and S22 in FIG. 9 may be eliminated, and even when no thread replacement is necessary at steps S24 to S27, the set thread spools 17 may be rearranged on the basis of the allotting process among the thread spools 17.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A multi-needle sewing machine, which is configured to sew an embroidery pattern composed of a plurality of partial patterns by using needle threads of colors differing per partial pattern, the machine comprising:

a plurality of needle bars having lower ends which are configured to accept needles;

a needle bar selecting unit which selectively switches one of the needle bars to a needle location;

a stitch number obtaining unit which obtains a number of stitches necessary for sewing each of the partial patterns; and an allotting unit which is configured to allot the needle threads to the needle bars so that the needle bars are prevented from being uneven in the number of stitches therebetween, based on the number of stitches obtained by the stitch number obtaining unit, in order that one of the needle bars to be used for the sewing of each partial pattern may be determined.

2. The machine according to claim 1, further comprising:

a counting unit which counts the number of stitches in a sewing operation; and a storage unit which stores data of the number of stitches counted by the counting unit as a cumulative stitch number, wherein the allotting unit allots the needle threads to the needle bars based on the number of stitches obtained by the stitch number obtaining unit and the cumulative stitch number stored on the storage unit so that a difference in a cumulative stitch number after sewing a partial pattern is rendered smaller between the needle bars.

3. The machine according to claim 1, wherein the needle threads are drawn from respective thread spools, and the allotting unit allots the needle threads to the needle bars every time of replacement of at least one thread spool corresponding to a needle thread to be replaced.

4. The machine according to claim 2, wherein the needle threads are drawn from respective thread spools, and the allotting unit allots the needle threads to the needle bars every time of replacement of at least one thread spool corresponding to a needle thread to be replaced.

5. The machine according to claim 1, further comprising an informing unit which informs a user of information about the stitch number for every needle bar.

6. The machine according to claim 2, further comprising an informing unit which informs a user of information about the stitch number for every needle bar.

7. The machine according to claim 3, further comprising an informing unit which informs a user of information about the stitch number for every needle bar.

8. The machine according to claim 4, further comprising an informing unit which informs a user of information about the stitch number for every needle bar.

* * * * *